United States Patent [19]

Buchter

[11] Patent Number: 5,064,391

[45] Date of Patent: Nov. 12, 1991

[54] ASYMMETRICAL HIGH DENSITY CONTACT RETENTION

[75] Inventor: Randolph L. Buchter, Harrisburg, Pa.

[73] Assignee: AMP Incorporated, Harrisburg, Pa.

[21] Appl. No.: 589,157

[22] Filed: Sep. 27, 1990

[51] Int. Cl.[5] ..... H01R 17/41

[52] U.S. Cl. ..... 439/733; 439/869

[58] Field of Search ..... 439/733, 84, 444, 869; 411/456

[56] References Cited

U.S. PATENT DOCUMENTS

| | | | |
|---|---|---|---|
| 1,410,210 | 3/1922 | Merkel et al. | 411/456 |
| 3,414,871 | 12/1968 | Tuchel | 339/217 |
| 3,579,178 | 5/1971 | Travis | 339/221 |
| 3,754,203 | 8/1973 | Pauza et al. | 339/17 CF |
| 3,897,131 | 7/1975 | Stauffer | 339/220 R |
| 4,147,400 | 4/1979 | Snyder, Jr. et al. | 339/217 S |
| 4,269,468 | 5/1981 | Ammon et al. | 439/733 |
| 4,457,573 | 7/1984 | Bailey et al. | 339/128 |
| 4,657,329 | 4/1987 | Dechelette | 339/97 P |
| 4,660,911 | 4/1987 | Reynolds et al. | 339/17 LC |
| 4,717,354 | 1/1988 | McCleerey | 439/444 |
| 4,726,792 | 2/1988 | Shindo | 439/748 |
| 4,775,336 | 10/1988 | Paulo | 439/830 |
| 4,808,125 | 2/1989 | Waters et al. | 439/607 |
| 4,889,502 | 12/1989 | Althouse et al. | 439/83 |

FOREIGN PATENT DOCUMENTS

| | | | |
|---|---|---|---|
| 55383 | 9/1912 | Fed. Rep. of Germany | 411/456 |
| 105297 | 6/1924 | Switzerland | 411/456 |
| 184052 | 7/1936 | Switzerland | 411/456 |

*Primary Examiner*—Gary F. Paumen

*Attorney, Agent, or Firm*—David L. Smith

[57] ABSTRACT

An electrical connector (20) is disclosed which includes a dielectric housing (24) having first and second contact receiving channels (40) with each channel defining a pair of side walls (154,156). A rib (158) on the housing separates the first and second channels (40) and extends between respective side walls (154,156) thereof. A first contact (22) is received in the first channel (40) with the first contact defining an axis (112) and having first and second side edges (100,102) on opposite sides of the axis. The first side edge (100) has a barb (108) extending therefrom away from the axis (112). The second side edge (102) has a barb (110) extending therefrom away from the axis (112) at a location spaced along the axis (112) a distance (122) from the barb (108) extending from the first side edge (100). The barb (108) extending from the first side edge (100) engages a side wall of the channel that forms the rib (158). The second contact (22) is received in the second channel (40) with the second contact also defining an axis (112) and having first and second side edges (100,102) on opposite sides of the axis. Each side edge (100,102) of the second contact has a barb (108,110) extending therefrom away from the axis (112) of the second contact (22) with the barbs extending from the contact at spaced locations therealong. The barb (108) extending from a first side edge (100) of the second contact (22) engages the side wall of the second channel (40) that forms the rib (158) to secure the second contact (22) in the second channel (40). In this manner, each contact (22) has an asymmetric barb retention system thereon such that a barb (110) on the first contact (22) engage side walls (154,156) of the rib (158) between the first and second channels (40) at spaced locations therealong.

10 Claims, 4 Drawing Sheets

FIG. 3
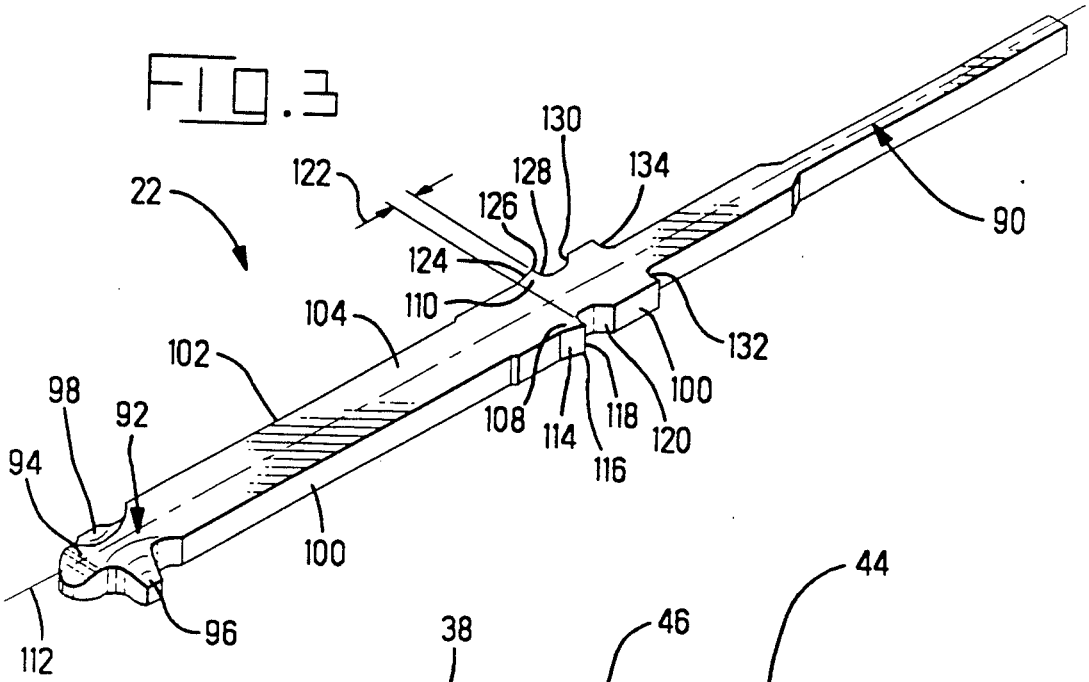
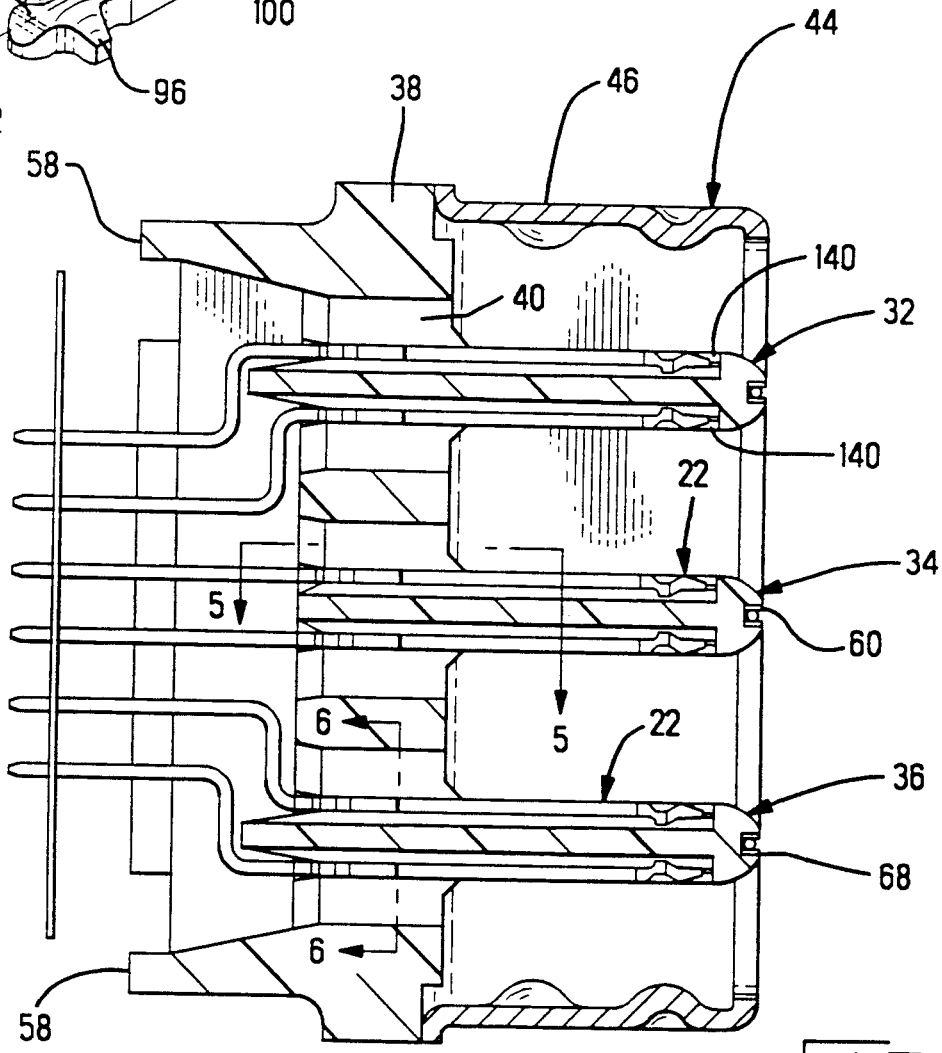
FIG. 4

ASYMMETRICAL HIGH DENSITY CONTACT RETENTION

BACKGROUND OF THE INVENTION

This invention relates to retaining contacts in the housing of electrical connectors and in particular to retaining very close center line spacing contacts in the housing of an electrical connector utilizing asymmetric retention features of the contact cooperating with structure of the housing.

As the down sizing of electronic devices has progressed, more contacts are placed in smaller and smaller connectors to consume less space. As the density of contacts in connectors increases, the center line spacing between contacts has decreased. Due to the higher density closer spacing of contacts, more attention must be given than in the past to the sufficiency of dielectric materials, whether plastic or air, separating the closest portions of adjacent contacts to assure that the contacts can withstand voltage levels sufficient to make the connector of practical use.

Contacts or terminals are pressed or pushed into contact receiving channels or passages during assembly of a connector. The contacts are positioned at a desired location in the channel or passage during manufacture and remain in that position during use of the connector.

Features of the contact typically secure the contact in the passage or channel such as a lance as disclosed in U.S. Pat. Nos. 3,414,871 and 4,726,792. When the contact is secured in a passage or channel by an interference fit, barb features on the contact plow through plastic of the dielectric housing in an interference fit and secure the contact in a passage or channel.

Typically the barb features are spaced symmetrically across the center line axis of the contact and if multiple barb features are present to enhance retention, they are spaced symmetrically across and axially along the contact. U.S. Pat. Nos. 4,775,336 and 4,808,125 disclose typical contact retention features of this type.

Some down sized symmetrical barb retention systems have been problematic in that barbs on opposite sides of a rib of dielectric material separating adjacent contact receiving channels of a dielectric connector housing have so stressed the dielectric material forming the rib that the dielectric material has failed. Sometimes the failure is audible. This failure provides a crack in the dielectric material that would otherwise separate the barbs of adjacent contacts thus changing the dielectric material separating the barbs from the plastic of the housing material to air. This can result in arcing between adjacent contacts through the crack across the resulting short distance of separation.

This type of housing dielectric failure can be affected by the thickness of dielectric material separating contacts, the extent to which barbs extend into the dielectric material, the voltage level of the signal on the contacts, the plastic material from which the connector is molded, and the proper processing of the plastic material such as preventing the plastic from becoming too hot during molding so as not to become brittle.

It would be desirable to have a contact retention system for high density contact spacing that would reduce the stress on the dielectric housing material separating adjacent contact receiving channels as contact receiving channels are positioned more closely together in higher density contact connectors.

SUMMARY OF THE INVENTION

In accordance with the present invention, an electrical connector includes a dielectric housing having first and second contact receiving channels with each channel defining a pair of side walls. A rib on he housing separates the first and second channels and extends between respective side walls thereof. A first contact is received in the first channel with the first contact defining an axis having first and second side edges on opposite sides of the axis. The first side edge has a barb extending therefrom away from the axis. The second side edge has a barb extending therefrom away from the axis at a location spaced along the axis from the barb extending from the first side edge. The barb extending from the first side edge engages a side wall of the channel that forms the rib. The second contact is received in the second channel with the second contact also defining an axis and having first and second side edges on opposite sides of the axis. Each side edge of the second contact has a barb extending therefrom away from the axis of the second contact with the barbs extending from the contact at spaced locations therealong. The barb extending from a first side edge of the second contact engages the side wall of the second channel that forms the rib to secure the second contact in the second channel. In this manner, each contact has an asymmetric barb retention system thereon such that a barb on the first contact and a barb on the second contact engage side walls of the rib between the first and second channels at spaced locations therealong.

BRIEF DESCRIPTION OF THE DRAWING

FIG. 3 is a perspective view of a contact retained in the connector of FIG. 1;

FIG. 4 is a cross section of the connector of FIG. 1 taken along the lines 4—4 in FIG. 1;

DESCRIPTION OF THE PREFERRED EMBODIMENT

Figure 1:
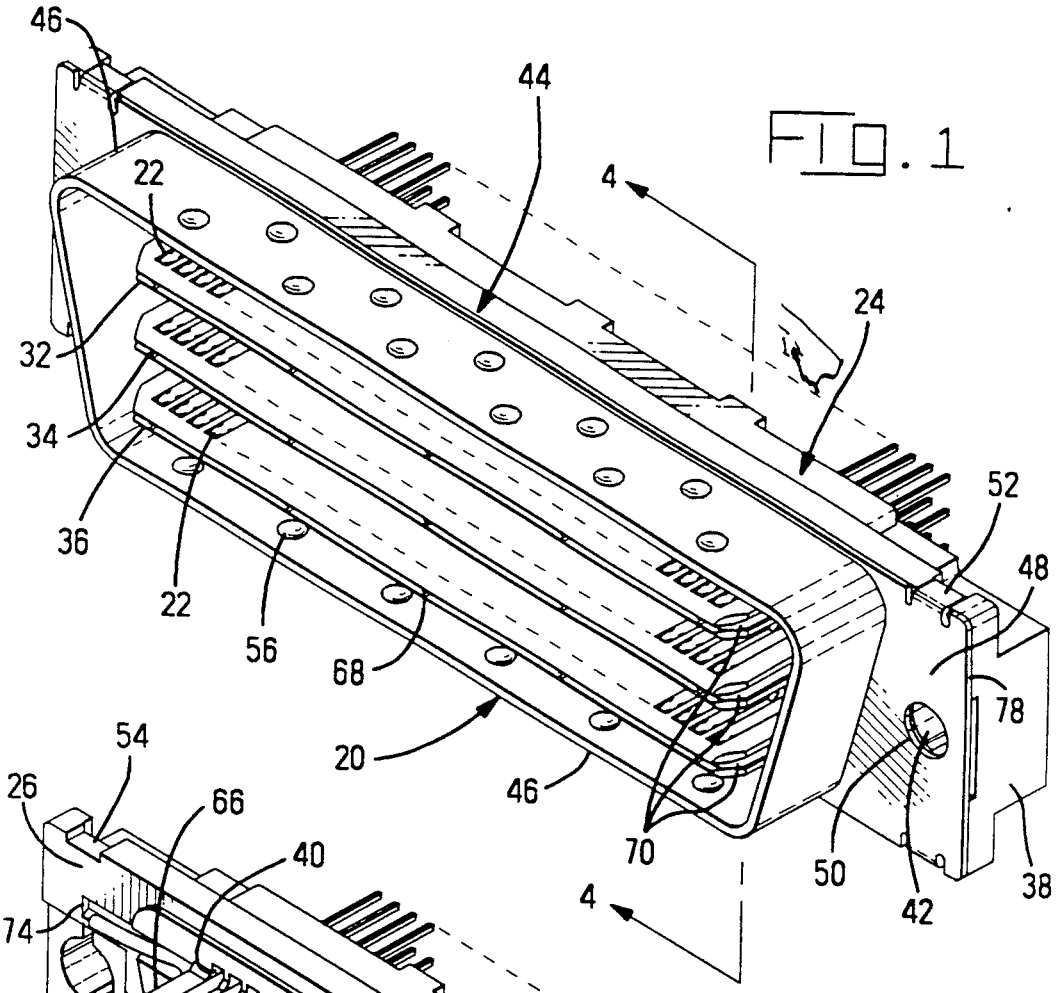
FIG. 1 is a perspective view of a connector with contacts having an asymmetric retention system, in accordance with the present invention.

A perspective view of a connector 20 in the form of a board mount vertical header employing contacts 22 having an asymmetric retention system in accordance with the present invention is shown in FIG. 1. Connector 20 includes insulative housing 24 molded of a suitable dielectric plastic material with integral peripheral flange 26, a mating side 28 and an opposed rear face 30. Three substantially identical spaced contact support fins 32, 34 and 36 extend from mating side 28. Extending through block 38 between mating side 28 and rear face 30 are a plurality of contact receiving channels 40 for receiving and securing contacts 22 in housing 24. Flange 26 has mounting apertures 42 at opposite ends thereof for mounting or securing a complementary connector thereto.

Figure 2:
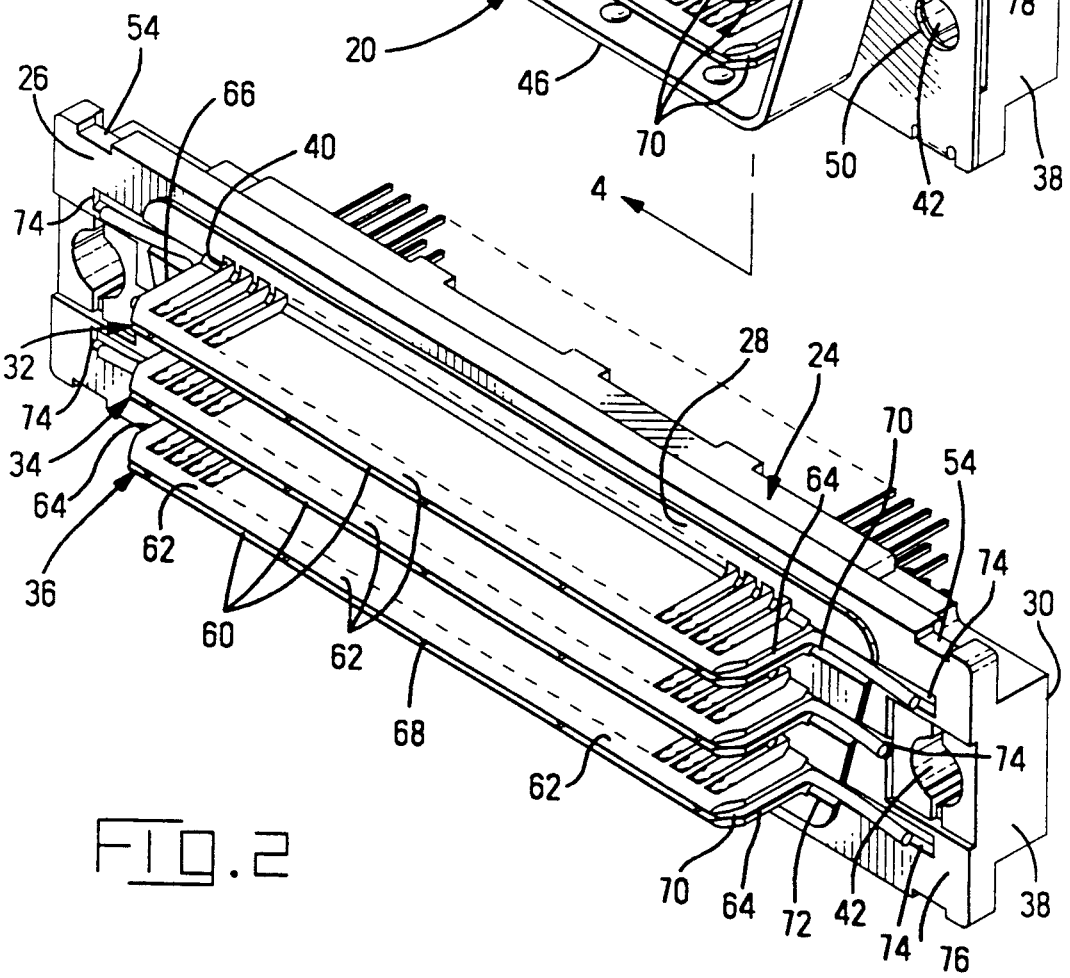
FIG. 2 is a perspective view of the dielectric housing of the connector of FIG. 1 after removal of the shell.

An shown in FIG. 2, electrically conductive shell 44 has a subminiature D shaped shroud 46 extending upwardly from mating side 28 and the flat portion 48 of shell 44. Shroud 46 provides a polarization feature to connector 20 and shields contacts 22 and fins 32, 34 and 36. The flat portion 48 of shell 44 has mounting apertures 50 aligned with apertures 42 in housing 24. Lugs 52 on the periphery of flat portion 48 fold into recesses 54 of housing 24 thereby securing shell 44 to housing 24. Shroud 46 may have inwardly directed resilient protrusions for grounding indents 56 to assure sufficient electrical and mechanical engagement between shroud 46 and the shroud of a mated complementary connector. At least a portion of the periphery of rear faced 30 provides a coplanar mounting face 58 (FIG. 4) which is received against a circuit board when connector 20 is mounted thereon.

Each contact support fin 32, 34 and 36 has an electrostatic discharge grounding wire slot 60 recessed in the distal edge 62. Slot 60 also extends along side edges 64 and 66. Spaced at intervals along slot 60 are inwardly directed interference protrusion 68 to reduce the cross section of slot 60 to provide an interference fit with an electrostatic discharge wire 70 received in slot 60 between a pair of protrusion 68 or between a protrusion 68 and the side wall of slot 60. Slot 60 at least along distal edges 62 is of slightly greater depth than the diameter of wire 70. Wire 70, typically manufactured of stainless steel for strength and corrosion resistance, bends substantially 90 degrees at the corner of fins 32, 34 and 36 where distal edge 62 intersects respective side edges 64 and 66. Wire 70 bends again proximate mating side 28 at the base 72 of fins 32, 34 and 36 to extend along mating side 28 outwardly away from the fins in respective electrostatic discharge channels 74 beyond respective side edges 64, 66 into flange 26. Electrostatic discharge channels 74 at least through the region of flanges 26 may be of a depth less than the diameter of wire 70 or the distal ends of wires 70 may extend upwardly from channels 74 to a location above surface 76. Wires 70 may be installed in slots 60 prior to shell 44 being secured to housing 24.

A drop-in insert (not shown) in accordance with the teaching of U.S. Pat. No. 4,889,502, the teaching of which is hereby incorporated by reference, may be inserted into apertures 42 before shell 44 is secured to housing 24. Thus, upon installation of shell 44, wires 70 are secured to housing 24 of connector 20 with wire 70 extending above the surface 76 of flange 26 to engage the under or rear surface 78 of flat portion 48 to make electrical and mechanical contact with shell 44. Wires 70 are thus electrically commoned to shell 44. Any electrostatic discharge discharged to wire 70 such as during mating with a complementary connector is carried to the same ground as shell 44.

FIG. 3 shows an enlarged perspective view of a contact 22. Each of contacts 22 in connector 20 is substantially identical. Contacts 22 are stamped and formed typically from phosphor bronze stock on the center line spacing they will be received in housing 24 and carried on a carrier strip to maintain the center lines spacing until assembly. The solder tails 90 may differ in length or formation to accommodate a particular footprint and may be plated as is known in the art.

Contact 22 has a leading end 92 having a coined tip 94 and locating wings 96, 98 extending laterally from end 92 to beyond respective side edges 100, 102. Wings 96 and 98 are formed out of the plane of contact 22 and thus the plane of end 92 at an angle away from contact surface 104 which is typically gold plated for engagement with a contact of a mating connector. Positioned along contact 22 near solder tail 90 are retention means 106 to secure contact 22 in housing 24. Retention means 106 include barbs 108 and 110 extending laterally from side edges 100 and 102, respectively. Barbs 108 and 110 extend away from center line 112 of contact 22 laterally beyond side edges 100 and 102.

Barb 108 has a tapered surface 114 which is angled away from center line 112 in the direction from leading end 92 to solder tail 90. Tapered surface 114 extends to tip 116. Shoulder 118 undercuts barb 108 and extends inwardly toward center line 112 beyond side edge 100. Surface 120 tapers outwardly from the innermost portion of shoulder 118 and intersects side edge 100. There may be other barbs extending from side edge 100 similar to barb 108 however, there is no barb extending from side edge 102 transverse to center line 112 across from barb 108.

At a location spaced distance 122 along center line 112 from barb 108, barb 110 extends laterally from side edge 102. Barb 110 has a tapered surface 124 which is angled away from center line 112 in the direction from leading end 92 to solder tail 90. Tapered surface 124 extends to tip 126. Shoulder 128 undercuts barb 110 and extends inwardly towards center line 112 beyond side edge 102. Surface 130 tapers outwardly from the innermost portion of shoulder 128 to intersect side edge 102. There may be other barbs extending from side edge 102 similar to barb 110. However, there is no barb extending from side edge 100 transverse to center line 112 across from barb 110.

In a preferred embodiment, there are only two barbs, one extending from each of the side edges of contacts 22 such that the tips of the barbs are at spaced positions therealong. Barbs 108, 110 thus provide an asymmetrical retention system for contacts 22.

Solder tail 90 is narrower than other portions of contact 22 defining rearwardly facing insertion shoulder 132 between side edge 100 and solder tail 90 as well as rearwardly facing shoulder 134 between side edge 102 and solder tail 90.

As best seen in FIG. 4, a portion of each channel 40 extends through block 38. Barbs 108 and 110 provide for the retention of contacts 22 in block 38 of housing 24. A portion of each channel 40 extends along a respective fin as channel 140. Extending angularly downwardly from channel 140 are wing receiving channels 142, 144.

Figure 5:
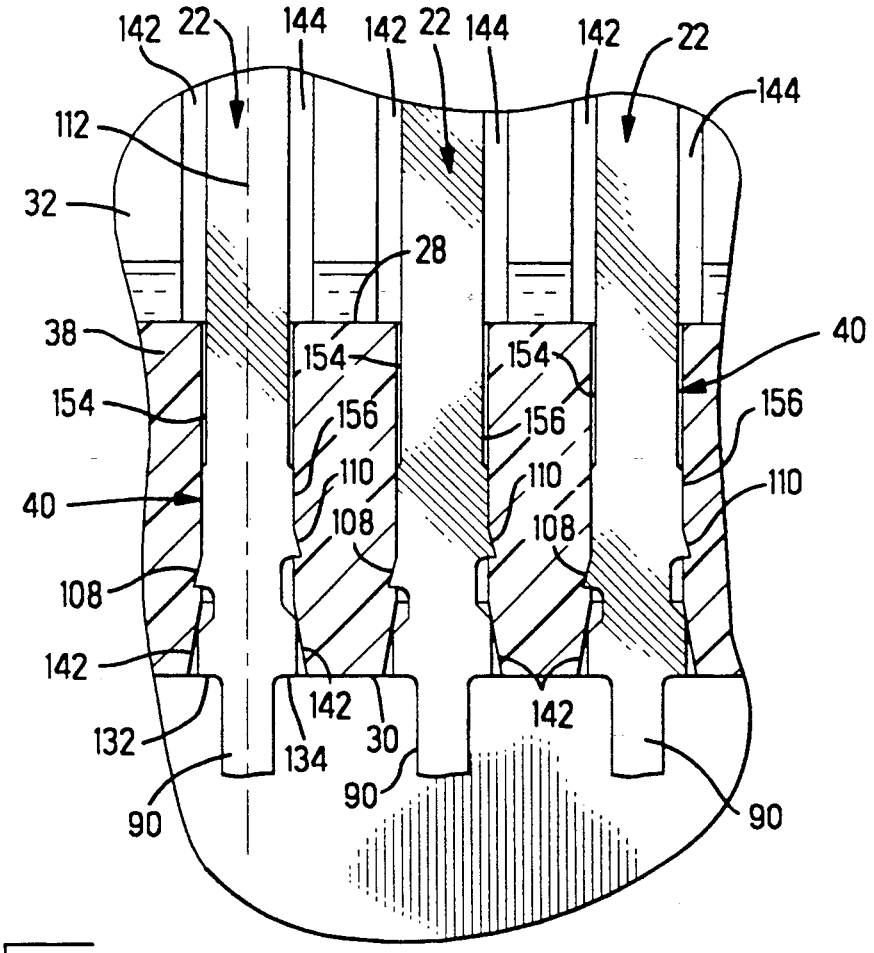
FIG. 5 is a partial cross sectional view of contacts in the housing of FIG. 4, taken along the lines 5—5 in FIG. 4.

FIG. 5 shows on an enlarged scale a partial sectional view of a housing 24 through block 38 showing a top view of three adjacent contacts 22 extending along upper contact support fin 32 in three adjacent channels 40 through block 38. These contacts and how they are retained in housing 24 are typical of all contacts in each of the fins 32,34 and 36. Each channel 40 extends from mating side 28 of block 38 to rear face 30 with each channel 40 widening near rear face 30 at tapered lead-in 146 to provide some lead-in for contacts 22 which are inserted during assembly from the rear, that is from rear face 30. Contacts 22 are inserted with tooling pressing on insertion shoulders 132, 134. Contacts 22 are all inserted to substantially the same depth with the result that insertion shoulders 132, 134 are substantially coplanar with rear face 30. In this position, the barbs 110 on contacts 22 substantially are aligned normal to the center line 112 of any contact 22, with barbs 108 of contacts 22 also aligned normal to center line of any contact, with barbs 108 at a location spaced distance 122 along center line 112 from barbs 110.

Figure 6:
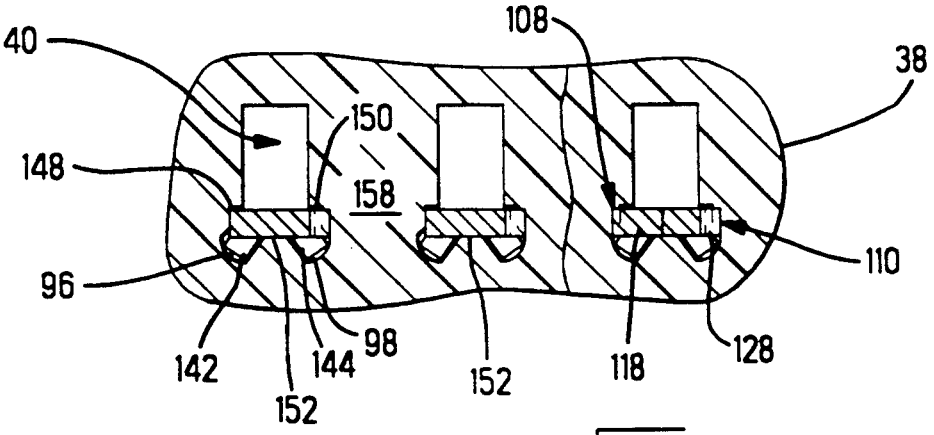
FIG. 6 is a partial cross sectional view of the connector housing of FIG. 4 showing contacts secured therein, taken along the lines 6—6 in FIG. 4.

The lower portion of channels 40 through block 38 is undercut at shoulders 148, 150 to receive contact 22 as shown in FIG. 6. During insertion of contact 22 into channel 40 of housing 24, contact 22 is positioned vertically by the undersurface sliding along the top of taper 152 formed between wing receiving channels 142 and 144, with a portion of the upper surface 104 of contact 22, along side edges 100 and 102, sliding under shoulders 148 and 150. Since the tips 116 and 126 of barbs 108, 110 extend to a tip-to-tip distance that is greater than the spacing between side walls 154 and 156, upon insertion of contacts 22 into channels 40 barbs 108 and 110 plow through the side walls with plastic flowing around tips 116, 126 to secure contacts 22 in housing 24 in an interference fit.

Ribs 158 are defined laterally by side walls 154 and 156 and extend between adjacent channels 40 through at least a portion of block 38. Each contact 22 has an asymmetric barb retention system in which a barb on a side edge of a contact received in one channel and a barb on the side edge of a contact received in an adjacent channel engage side walls of the rib separating the two channels at spaced locations therealong. In this manner, contacts received in adjacent channels each have a barb that engages side walls of the rib therebetween with the barbs engaging the rib from opposite sides at locations spaced along the center line of the contact.

In the preferred embodiment, contacts 22 are 0.035 inch (0.900 mm) wide between side edges 100 and 102. The barbs 108 and 110 extend outwardly away from center line 112 a distance of 0.003 to 0.004 inch (0.076 mm to 0.102 mm) with the rib 158 between adjacent channels 40 in the plane of contacts 22 being substantially 0.015 inch (0.38 mm). Thus, with the barbs extending into a rib between adjacent channels from opposite directions, if the barbs were aligned transverse to the center lines of a contact one could only be assured of 0.008 inch (0.20 mm) separating the tips of the barbs. With the barbs at spaced locations as in the asymmetric retention system described herein, 0.012 inch 0.305 mm) of the dielectric housing material could be assured as separating the tip of a barb of one contact from a side edge of the contact in the adjacent channel.

Figure 7:
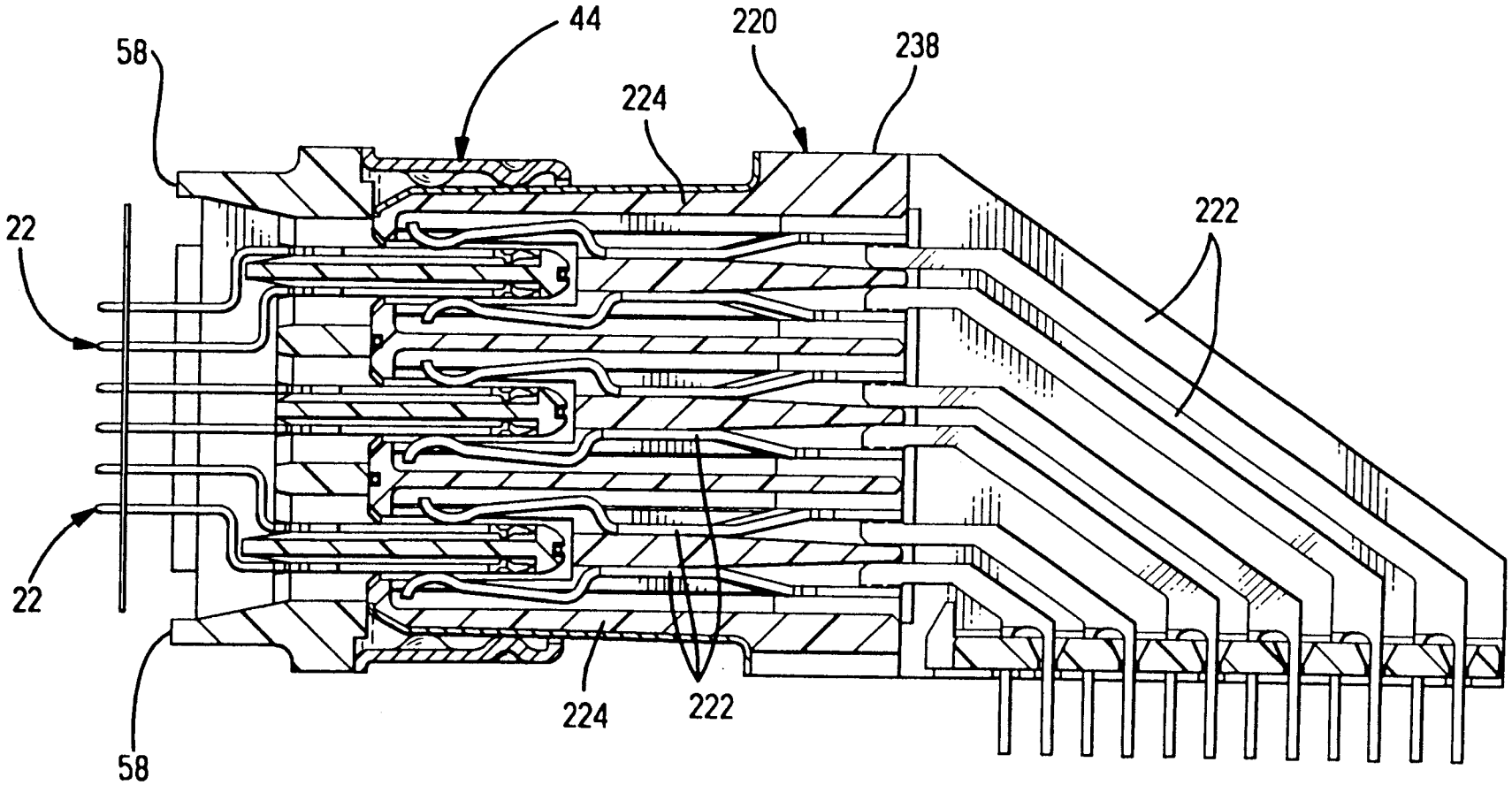
FIG. 7 is a cross section of an alternate embodiment connector having contacts retained therein by an asymmetric retention system in accordance with the present invention.

An alterative embodiment connector 220 in a form of a right angle receptacle is shown in cross section in FIG. 7. Connector 220 employs the contact retention system of the present invention to secure contacts 222 in block 238 of housing 224.

I claim:

1. An electrical connector having an asymmetric contact retention system, comprising:

a dielectric housing defining first and second contact receiving channels, each channel having a side wall;

a rib on said housing separating said first and second channels, said rib extending between said side walls;

a first contact received in said first channel, said first contact defining an axis, said first contact having first and second side edges on opposite sides of said axis, said first side edge having a barb extending therefrom away from said axis, said second side edge having a barb extending therefrom away from said axis, the barb extending from said second side edge at a location spaced along the axis from the barb extending from said first side edge, the barb extending from said first side edge engaging the side wall of said first channel to secure said first contact in said first channel;

a second contact received in said second channel, said second contact defining an axis, said second contact having first and second side edges on opposite sides of the axis of said second contact, said first side edge of said second contact having a barb extending therefrom away from the axis of said second contact, said second side edge of said second contact having a barb extending therefrom away from the axis of said second contact, the barb extending from said second side edge of said second contact engaging the side wall of said second channel to secure said second contact in said second channel, whereby the first contact has asymmetric barbs thereon and the second contact has asymmetric barbs thereon such that a barb on the first contact and a barb on the second contact engage side walls of the rib between the first and second channels at spaced locations therealong.

2. An electrical connector as recited in claim 1, wherein the first and second contacts are identical.

3. An electrical connector as recited in claim 1, wherein each of the first and second contacts have only two barbs.

4. An electrical connector as recited in claim 1, wherein the barb extending from the second side edge of the second contact is positioned at a location spaced along the axis of the second contact from the barb extending from the first side edge of the second contact.

5. An electrical connector as recited in claim 1, wherein the barb extending from the first side edge of the first contact and the barb extending from the second side edge of the second contact engage sidewalls of the rib at axially spaced locations therealong.

6. An electrical connector having an asymmetric contact retention system comprising:

a dielectric housing defining a spacer member separating first and second contact receiving channels, each of said first and second channels defining first and second side walls such that the spacer member is between the first side wall of the first channel and the second side wall of the second channel;

a first contact received in said first channel, said first contact defining an axis and having asymmetric retention means extending from first and second side edges on opposite sides of said axis, said first side edge having retention means extending therefrom away from said axis, said second side edge having retention means extending therefrom away from said axis at a location spaced along the axis of said first contact from said retention means on said first side, said first retention means engaging said first side wall to secure said first contact in said first channel;

a second contact received in said second channel, said second contact defining an axis and having asymmetric retention means extending from first and second side edges on opposite sides of said axis, said first side edge of said second contact having a retention means extending therefrom away from said axis of said second contact, said second side edge of said second contact having a retention means extending therefrom away from said axis of said second contact at a location spaced along the axis of said second contact a predetermined distance from said retention means on said first side edge of said second contact, said second retention means on said second contact engaging said second side wall of said second channel to secure said second contact in said second channel, whereby the first contact has asymmetric retention means thereon and the second contact has asymmetric retention means thereon such that a retention means on the first contact and a retention means on the second contact engage side walls of the spacer ember between the first and second channels at spaced locations therealong.

7. An electrical connector as recited in claim 6, wherein said first and second contacts are identical.

8. An electrical connector as recited in claim 6, wherein each of said first and second contacts have only two retention means.

9. A connector having a plurality of terminal-receiving passageways and a like plurality of terminals having sections to be inserted into respective ones of said terminal-receiving passageways to be housed, said passageways being of the type defined by thin planar barrier walls therebetween for close terminal spacing, and said terminals being of the type self-retaining in respective said passageways by barb means, the improvement comprising:

said terminals each having a first barb extending from a first side thereof at a first axial location and a second barb extending from a second side opposed from said first side and at a second axial location axially offset from said first axial location, whereby upon insertion of said terminals into respective said passageways with said first side spacing a common first direction, said first barbs extend in said common first direction penetrating into first wall surfaces of said barrier walls forming a common opposed second direction and distinctly axially offset from said second barbs of adjacent ones of said terminal penetrating into second wall surfaces forming the opposite sides of said barrier walls, thereby enabling said barrier walls to be thin without being weakened by barbs penetrating opposite sides at substantially the same axial location and enabling housed sections of said terminals to be identical.

10. An electrical connector having an asymmetric contact retention system, comprising:

a dielectric housing defining first and second contact receiving channels, each channel having a side wall;

a rib on said housing separating said first and second channels, said rib extending between said side walls;

a first contact received in said first channel, said first contact defining an axis, said first contact having first and second side edges on opposite sides of said axis, said first side edge having at least one retention means extending therefrom away from said axis, said second side edge having at least one retention means extending therefrom away from said axis, each of said at least one retention means extending from said second side edge positioned at a location spaced along the axis from each of said at least one retention means extending from said first side edge, said at least one retention means extending from said first side edge engaging the side wall of said first channel to secure said first contact in said first channel;

a second contact received in said second channel, said second contact defining an axis, said second contact having first and second side edges on opposite sides of the axis of said second contact, said first side edge of said second contact having at least one retention means extending therefrom away from the axis of said second contact, said second side edge of said second contact having at least one retention means extending therefrom away from the axis of said second contact, each of said at least one retention means extending from said second side edge of said second contact positioned at a location spaced along the axis of said second contact from each of said retention means extending from said first side edge of said first contact, said at least one retention means extending from said first side edge engaging the sidewall of said second channel to secure said second contact in said second channel, whereby each of the retention means on the first contact and each of the retention means on the second contact engage sidewalls of the rib between the first and second channels at axially displaced locations therealong.

* * * * *

UNITED STATES PATENT AND TRADEMARK OFFICE

CERTIFICATE OF CORRECTION

PATENT NO. : 5,064,391

DATED : November 12, 1991

INVENTOR(S) : Randolph L. Buchter

It is certified that error appears in the above-identified patent and that said Letters Patent is hereby corrected as shown below:

Abstract: line 31, after "contact (22)", please insert --and a barb (108) on the second contact (22)--.

Column 7, line 6, after "means on said:", please insert --side edge of said second--.

line 14, please delete "ember" and replace with --member --.

Signed and Sealed this

Third Day of August, 1993

*Attest:*

Michael K. Kirk

MICHAEL K. KIRK

*Attesting Officer*

*Acting Commissioner of Patents and Trademarks*